United States Patent [19]

Solidum

[11] Patent Number: 5,051,317

[45] Date of Patent: Sep. 24, 1991

[54] MULTILAYERED ELECTROPLATING PROCESS UTILIZING FINE GOLD

[75] Inventor: Hamilton Solidum, Dayton, N.J.

[73] Assignee: Krementz & Co. Inc., Newark, N.J.

[21] Appl. No.: 460,359

[22] Filed: Jan. 3, 1990

[51] Int. Cl.[5] ..... B32B 15/01; B32B 15/20; C25D 5/10; C25D 5/12

[52] U.S. Cl. ..... 428/671; 428/672; 204/40; 63/2

[58] Field of Search ..... 204/40; 428/671, 672; 63/2, 3, 15

[56] References Cited

U.S. PATENT DOCUMENTS

| | | | |
|---|---|---|---|
| 3,708,405 | 1/1973 | Kamata | 204/40 |
| 3,963,455 | 6/1976 | Nobel et al. | 428/672 |
| 4,533,605 | 8/1985 | Hoffman | 63/3 |
| 4,601,958 | 7/1986 | Levine | 204/40 |
| 4,666,796 | 5/1987 | Levine | 204/40 |
| 4,835,067 | 5/1989 | Levine | 204/40 |

OTHER PUBLICATIONS

Nobel et al., "An Evaluation of 18 Karat and 24 Karat Hard Gold Deposits for Contact Applications", *Plating*, Jul. 1973.

*Primary Examiner*—John F. Niebling
*Assistant Examiner*—David G. Ryser

[57] ABSTRACT

Disclosed herein is a process for the electrodepositing multiple layers of fine gold and bright nickel upon a substrate layer. Fine gold is defined as being 99.99% pure. By insulating bright nickel between layers of fine gold, the galvanic effect is substantially reduced. This process is uniquely suited to jewelry products, where the substrate layers are ordinarily composed of brass.

7 Claims, 1 Drawing Sheet

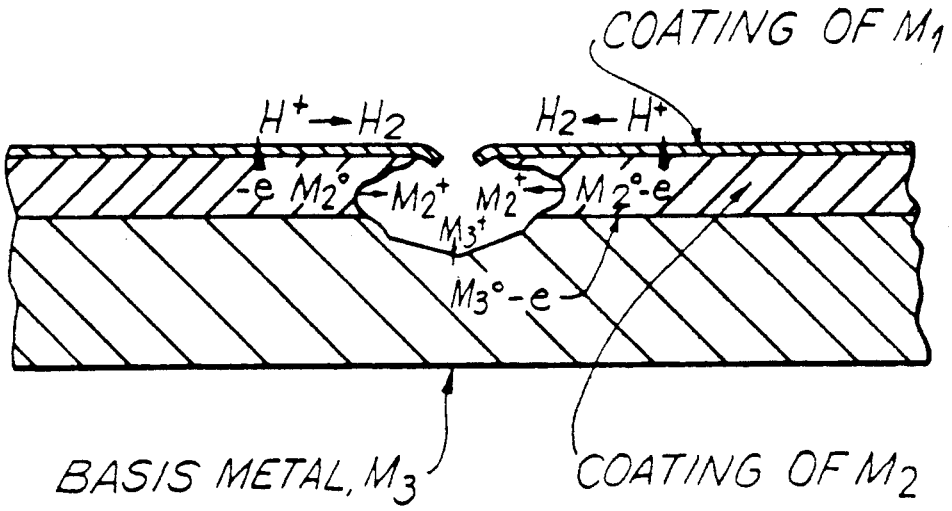
COATING OF $M_1$
$H^+ \rightarrow H_2$
$H_2 \leftarrow H^+$
$-e$ $M_2^\circ$
$\leftarrow M_2^+$
$M_2^+ \rightarrow$
$M_2^\circ - e$
$M_3^+$
$M_3^\circ - e$
BASIS METAL, $M_3$
COATING OF $M_2$

MULTILAYERED ELECTROPLATING PROCESS UTILIZING FINE GOLD

FIELD OF THE INVENTION

The invention described herein is an electroplating process which utilizes fine gold as a means of insulating layers of different metals which would corrode if in direct contact with each other. In particular is described its utilization as an inhibitor to the galvanic effect occurring when nickel and brass are the two metal layers. Fine gold, as used herein, refers to 24 karat (24K) gold, which is 99:99% pure.

BACKGROUND OF THE INVENTION

Multilayered plating processes are known and disclosed as means for inhibiting corrosion mechanisms such as the galvanic effect, which arises where different metals having different electromotive potentials contact each other directly or through a conductive medium. The differing electromotive potentials of the metals create an electrical potential between the two metals causes corrosion to occur upon the surface metals.

Other factors contribute to the corrosion of metal layers, such as the chemical nature of the metal, the purity of the metal, the physical and mechanical condition of the metal, and the environment to which the metal is exposed.

A review of the prior art reveals many different methods of electrodepositing, electroplating multiple layers of different metals as a means for inhibiting corrosion. For instance, in U.S. Pat. Nos. 4,601,958 and 4,666,796 to Levine it is disclosed that metal parts for the sealing of semiconductor packages comprising an iron based alloy layer is electroplated with a first layer of nickel, then electroplated with a first layer of gold, then electroplated with a second nickel layer, and then electroplated with a second gold layer. In U.S. Pat. No. 3,708,405 to Kamata, it is disclosed that a copper alloy wire is electroplated first with a layer of nickel, second with a layer of gold, third with another layer of nickel, and fourth with another layer of gold.

U.S. Pat. No. 4,835,067 to Levine discloses an electroplating process suitable for use as sealing lids or cover elements for semiconductor packages in which substrate layers that are nickel containing iron alloys are electroplated with a base layer of a metal with an electromotive potential high with respect to that of the substrate, over which an intermediate layer is electroplated, which intermediate layer has an electromotive potential which is low with respect to the base layer, and over that a cover layer is plated which has an electromotive potential similar to that of the base layer. It is further disclosed that suitable combinations of the electroplated layers are gold-nickel-gold combinations.

Other multilayered electrodepositing methods utilizating gold are known in the art. U.S. Pat. No. 3,963,455 to Nobel discloses the electrodepositing of a tungsten-cobalt alloy or tungsten nickel alloy layer between the base metal and the gold electrodeposit layer in order to prevent a barrier to diffusion.

A review of the above-referenced and other prior art reveals that while many electroplating processes and their applications have been developed, no such applications adequately solve the unique problems encountered in the jewelry industry.

Because of the prohibitive cost of gold, jewelry manufactured today is rarely composed of solid gold.

Rather, most jewelry is composed of base metals such as brass, which is then plated with a gold finish. Brass is the favored base material because it may be cast while in its molten form into many different shapes. A layer of bright nickel is ordinarily employed in combination with the brass. Nickel is a preferred component because it creates a shiny metallic appearance. However, because of the electromotive potential that results when brass and nickel are in contact with each other, a jewelry product of this composition is prone to corrosion that tarnishes its appearance, an aesthetically unpleasing condition that ruins the inherent beauty of the article.

In jewelry products, corrosive effects are due to the galvanic effect, the environment in which the jewelry is worn, and the physical and mechanical conditioning of the metal. Environmental factors which can cause corrosion are contact with water, sweat and other moisture, all of which serve as a conducting medium for the flow of electrons. For this reason there is a greater likelihood of corrosion where the jewelry comes in contact with moisture.

The manufacture of the jewelry itself may also act as a corrosion promoting mechanism. Jewelry is machined during manufacture, stressing the metal and creating fissures where corrosion can occur. Of course, such stressing is not limited to the manufacturing process, as the care exhibited by the jewelry owner is an important factor. Scratches, nicks, etc. occurring when the jewelry is worn create fissures which promote corrosive effects.

The conventional process which has been employed in the art is to electrodeposit a layer of bright nickel upon the brass substrate, and then to electroplate a layer of gold upon the outer surface. However, these products have a limited ability to resist corrosion and will eventually break down, as depicted in FIG. 1, which is a reprint of a FIG. 6–7 of Faust, "Corrosion and Protective Coating", Metals Engineering Institute, p. 6–10, 1977.

A corrosion pit can form where a noble (i.e. less negative) metal $M_1$ on the outside surface is plated over a metal $M_2$ which is less noble (i.e.—more negative) and is upon base metal $M_3$. As can be seen, this coating method does nothing to prohibit galvanic action, as electrons flow from the substrate layer up to the intermediate layer, and then up to the surface layer.

Sometimes a thick layer of gold or another intermediate layer is applied over the nickel to assure longer wear. Under these situations, the product often experiences corrosion originating from interactions between base metal, the undercoat layers, and covering layer of gold.

An added factor is that the product is exposed to an assortment of plating solution additives which are, used to improve the brightness, leveling, and/or luster of product. These additives tend to accelerate delimination, corrosion, or failure of the outer and inner coatings.

SUMMARY OF THE INVENTION

It is an object of the invention to provide a process for inhibiting corrosive effects arising when metals of different compositions are in contact with each other by electrodepositing fine gold as an insulating layer.

It is a further object of the invention to provide a process of electroposition which will inhibit the corrosive effects arising when brass and nickel as in contact with each other.

It is a further object of the invention to provide a method which will serve to inhibit other corrosion causing mechanisms, such as the environment and mechanical stressing.

Other objects of the invention shall be apparent from the description of the invention below.

In order to inhibit corrosion mechanisms it is proposed that the substrate be electroplated with a layer of fine gold, and then electroplated with a layer of nickel. Upon the nickel layer a second layer of fine gold is electroplated, and a layer of heavy gold (18K) is then electroplated upon that.

By insulating the nickel layer with fine gold, the metals which create the galvanic action do not contact each other.

This physical barrier prohibits corrosive effects between the nickel layer and the base layer.

Fine gold is uniquely suited to prohibiting the corrosion which is encountered with jewelry. First, because of its relative softness fine gold cuts to relieve stresses which would otherwise develop between the coated layers. The softness of the fine gold will prevent the development of fissures between the layers which would promote corrosion mechanisms. Secondly, because of its high purity, fine gold is highly noble, and its presence serves to reduce the electromotive potential to negligible levels. And most importantly, it is the inventor's experience that fine gold is better suited for the prohibition of the galvanic effect than less pure gold. This is critical, as the bright nickel utilized in the jewelry making process is by far more prone to corrosion than ordinary nickel platings.

DETAILED DESCRIPTION

The brass substrate is prepared for the electroplating process in the following manner. The total plating area is determined, the substrates undergo ultrasonic cleaning, are rinsed, and then electrocleaning, both cleaning processes being in accordance with methods known in the art. The substrates are then subjected to an acid rinse of 10% sulfuric acid in water in order to neutralize metal oxides, and then rinsed in water.

The surfaces of the substrate are then subjected to a surface activation process in accordance with those methods known in the art in order to dissolve metal oxides.

The brass substrates are now prepared for the electroplating process. In order to promote good adhesion of the electroplated layers, a gold strike layer is first deposited upon the substrate, using Degussa's No. 122 electroplating process or its equivalent, at a concentration of 1 $^{9}/_{l}$ of gold. The strike layer is deposited at 5v. and 140° F. for 15 seconds or until all substrate is coated with gold. The substrates are then rinsed with cold water.

The substrates are now ready for the electrodepositing of the first layer of fine gold. Electrodepositing of the fine gold is achieved by using Engelhard's E-56 pure gold plating process or equivalent, the solutions being available from Engelhard Corp., East Newark, N.J. The concentration of the baths is 8 gm/l of fine gold, which is plated at 20 seconds (or as required by the calculations of surface area) at 3.5 volts and 40° F. with cathode agitation. The plated materials are then rinsed in cold water rinse, an acid rinse (described above), subjected to an acid activator (as described above), (an acid activator (as described above)) another cold water rinse, and then is ready for plating of the nickel layer.

Nickel plating occurs at 20 to 80 amps per square foot (ASF) for ten minutes or as required until the pieces are mirror bright in appearance.

After rinsing and acid activation in the manner described above, the plated materials are then subjected to a second gold strike, followed by a second plating with soft gold in the manner described above.

After a cold water rinse, the materials are then plated with a heavy gold plate. The electroplating bath is a Degussa 507-18K gold plating bath containing 5 gm/l gold, 75.0 gm/l copper, 1.0 gm/l cadmium, and 20.0 g/l potassium cyanide. The process is carried out at 5 ASF—20 ASF per calculated amp/min, or at a gold thickness of 2.5 to 10 micron as required by the practitioner.

The items are then subjected to an ultrasonic treatment to enhance the surface brightness and luster. The electroplated items are then rinsed with cold water, acid, and cold water, then electroplated for 15 seconds or as required for uniform gold color with Degussa No. 122 color gold process or equivalent. The process is completed after a second ultrasonic treatment.

I claim:

1. A process for inhibiting corrosion which affects jewelry products wherein a bright nickel layer and a base metal are insulated from each other by first electrodepositing a layer of fine gold upon the base metal, second electrodepositing a layer of bright nickel upon the fine gold electrodeposited layer, and third electrodepositing a layer of fine gold upon the bright nickel layer.

2. A process according to claim 1 comprising the further step of electrodepositing a layer of heavy gold upon the second electrodeposit layer of fine gold.

3. A process according to claim 1 whereby the base metal is brass.

4. A plated jewelry article according to the process set forth in claim 1.

5. An article of jewelry having a substrate of brass, having electroplated upon the substrate metallic layers comprised of:

a) a first layer of fine gold;

b) a second layer of bright nickel;

c) a third layer of fine gold; whereby the electroplating of said layers inhibits the onset of corrosion which affects the article.

6. An article of jewelry as set forth in claim 5, further comprised of a fourth layer of 18 karat gold.

7. An article of jewelry as set forth in claim 5 wherein the fine gold layers exhibit a ductility as a corrosion inhibiting means.

* * * * *